US006554530B2

(12) United States Patent
Moore

(10) Patent No.: US 6,554,530 B2
(45) Date of Patent: Apr. 29, 2003

(54) ENERGY ABSORBING SYSTEM AND METHOD

(76) Inventor: Joseph W. Moore, 607 Arnett Blvd., Danville, VA (US) 24540

( * ) Notice: Subject to any disclaimer, the term of this patent is extended or adjusted under 35 U.S.C. 154(b) by 0 days.

(21) Appl. No.: 09/819,417

(22) Filed: Mar. 28, 2001

(65) Prior Publication Data

US 2002/0141818 A1 Oct. 3, 2002

(51) Int. Cl.[7] ..... E01F 15/08; E01F 15/02

(52) U.S. Cl. ..... 404/6; 404/9; 256/13.1

(58) Field of Search ..... 404/6, 7, 9, 10; 256/1, 13.1

(56) References Cited

U.S. PATENT DOCUMENTS

| | | | | | |
|---|---|---|---|---|---|
| 2,974,934 | A | * | 3/1961 | White | 256/13.1 |
| 3,674,115 | A | * | 7/1972 | Young et al. | 256/13.1 |
| 3,845,936 | A | * | 11/1974 | Boedecker, Jr. et al. | 256/1 |
| 3,982,734 | A | * | 9/1976 | Walker | 256/13.1 |
| 4,452,431 | A | * | 6/1984 | Stephens et al. | 256/13.1 |
| 4,583,716 | A | * | 4/1986 | Stephens et al. | 256/13.1 |
| 4,607,824 | A | * | 8/1986 | Krage et al. | 404/6 |
| 4,784,515 | A | * | 11/1988 | Krage et al. | 404/6 |
| 4,815,565 | A | * | 3/1989 | Sicking et al. | 256/1 |
| 5,112,028 | A | * | 5/1992 | Laturner | 256/13.1 |
| 5,314,261 | A | * | 5/1994 | Stephens | 404/6 |
| 5,645,368 | A | | 7/1997 | Yunick | |
| 5,749,193 | A | | 5/1998 | Bucher | |
| 5,788,405 | A | * | 8/1998 | Beard | 116/63 P |
| 5,797,592 | A | * | 8/1998 | Machado | 404/6 |
| 6,010,275 | A | | 1/2000 | Fitch | |
| 6,059,487 | A | | 5/2000 | Haga et al. | |
| 6,092,959 | A | | 7/2000 | Leonhardt et al. | |
| 6,116,805 | A | | 9/2000 | Gertz | |
| 6,301,831 | B1 | * | 10/2001 | Cundy et al. | 404/10 |

* cited by examiner

*Primary Examiner*—Thomas B. Will
*Assistant Examiner*—Alexandra K. Pechhold

(57) ABSTRACT

An energy absorbing system is provided to protect vehicle drivers and the like from serious injury which may occur when the vehicle strikes a wall or other rigid structure. The system utilizes a plurality of energy absorbing units having hinged plates with a cushion backing which dampens the impact by swinging in an overlapping fashion. The plates are formed from steel and the cushion is formed with a high density outer polymeric casing and a relatively low density filler within.

7 Claims, 3 Drawing Sheets

ENERGY ABSORBING SYSTEM AND METHOD

FIELD OF THE INVENTION

The invention herein pertains to an energy absorbing system used as a vehicle crash barrier, lane barricade or lane divider and particularly pertains to an energy absorbing system for attachment to a rigid racetrack wall.

DESCRIPTION OF THE PRIOR ART AND OBJECTIVES OF THE INVENTION

In recent years all forms of vehicle racing have become increasing popular and speeds have increased in many events to over 200 miles per hour (321.8 k/h). To protect the large audiences which now attend the races, track owners have installed rigid perimeter walls, barriers and the like, usually formed of concrete reinforced with steel. While such measures have provided protection for spectators, increasing numbers of race car drivers have been seriously injured or killed as their vehicles impact the rigid walls even with various types of standard crash barriers being utilized. Conventional crash barriers include stacks of vehicle tires, compression guardrails; plastic, liquid or sand filled barrels or the like. While all of these prior devices are beneficial in certain circumstances, most are difficult to install and maintain and a satisfactory system for preventing serious injury to race car drivers traveling at high speeds is still needed which is practical, safe and easily maintainable.

Thus, with the known problems and disadvantages of present crash safety methods and devices, the present invention was conceived and one of its objectives is to provide an energy absorbing system for attachment to a rigid racetrack wall or other support to more safely dissipate the energy generated during vehicle crashes for driver protection.

It is another objective of the present invention to provide an energy absorbing system having a plurality of energy absorbing units which includes a hinged plate having a cushion attached with adhesive.

It is still another objective of the present invention to provide an energy absorbing system which can be easily installed on existing racetrack and other rigid walls or supports.

It is yet another objective of the present invention to provide an energy absorbing system which utilizes collapsible cushions formed with a tough, durable outer skin or casing and a less dense inner filler.

It is still another objective of the present invention to provide an energy absorbing system in which energy absorbing units are individually attached to the wall in an angular, overlapping fashion.

It is a further objective of the present invention to provide an energy absorbing system formed from a plurality of energy absorbing units having a rigid front plate formed from steel and a cushion formed from a polymeric material attached to the rear surface of the plate.

It is still a further objective of the present invention to provide a method of safely dissipating energy such as caused by a vehicle striking a wall utilizing the energy absorbing system described herein.

Various other objectives and advantages of the present invention will become apparent to those skilled in the art as a more detailed description is set forth below.

SUMMARY OF THE INVENTION

The aforesaid and other objectives are realized by providing an energy absorbing system and method of use including a plurality of energy absorbing units which are each angularly, pivotally affixed to a rigid support structure such as a racetrack wall. Each energy absorbing unit includes a rigid front plate formed from steel and a cushion affixed to the rear surface thereof. The cushion is formed from a polymeric material having a casing to prevent excessive shard dispersion of the less dense inner polymeric filler as a result of an impact thereto. The energy absorbing units are positioned in somewhat of an overlapping fashion along the inside of the racetrack wall whereby when struck by a vehicle, the energy absorbing units collapse towards the wall, striking successive units which dissipate the energy created to thereby lessen the danger of serious injury to the vehicle driver.

DETAILED DESCRIPTION OF THE PREFERRED EMBODIMENT AND OPERATION OF THE INVENTION

Figure 1:
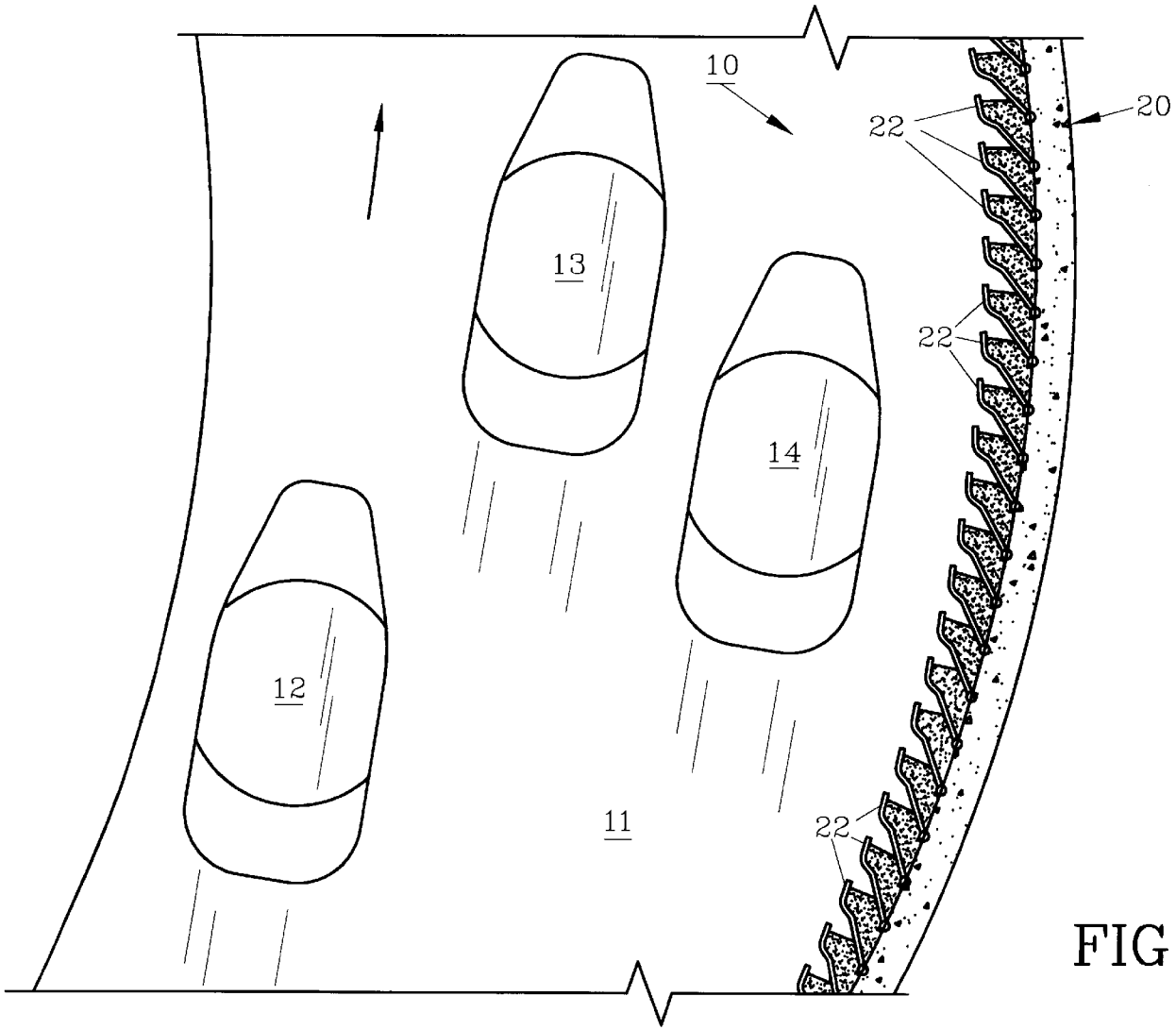
FIG. 1 illustrates a typical arcuate portion of a racetrack with the energy absorbing system mounted on a concrete wall.

For a better understanding of the invention and its method of operation, turning now to the drawings, FIG. 1 shows preferred energy absorbing system 10 in conjunction with racetrack 11 having race cars 12–14 thereon. Energy absorbing system 10 is joined to the inside of concrete wall 20 which surrounds the outer perimeter of racetrack 11. Energy absorbing system 10 includes a plurality of preferred energy absorbing units 22 which are each pivotally mounted to wall 20 at an angle (ø) of preferably about 30° (FIG. 6) from the normal direction of race car travel. As would be understood, energy absorbing system 10 is preferably placed completely around racetrack 11 but can be only proximate the turns as desired.

Figure 2:
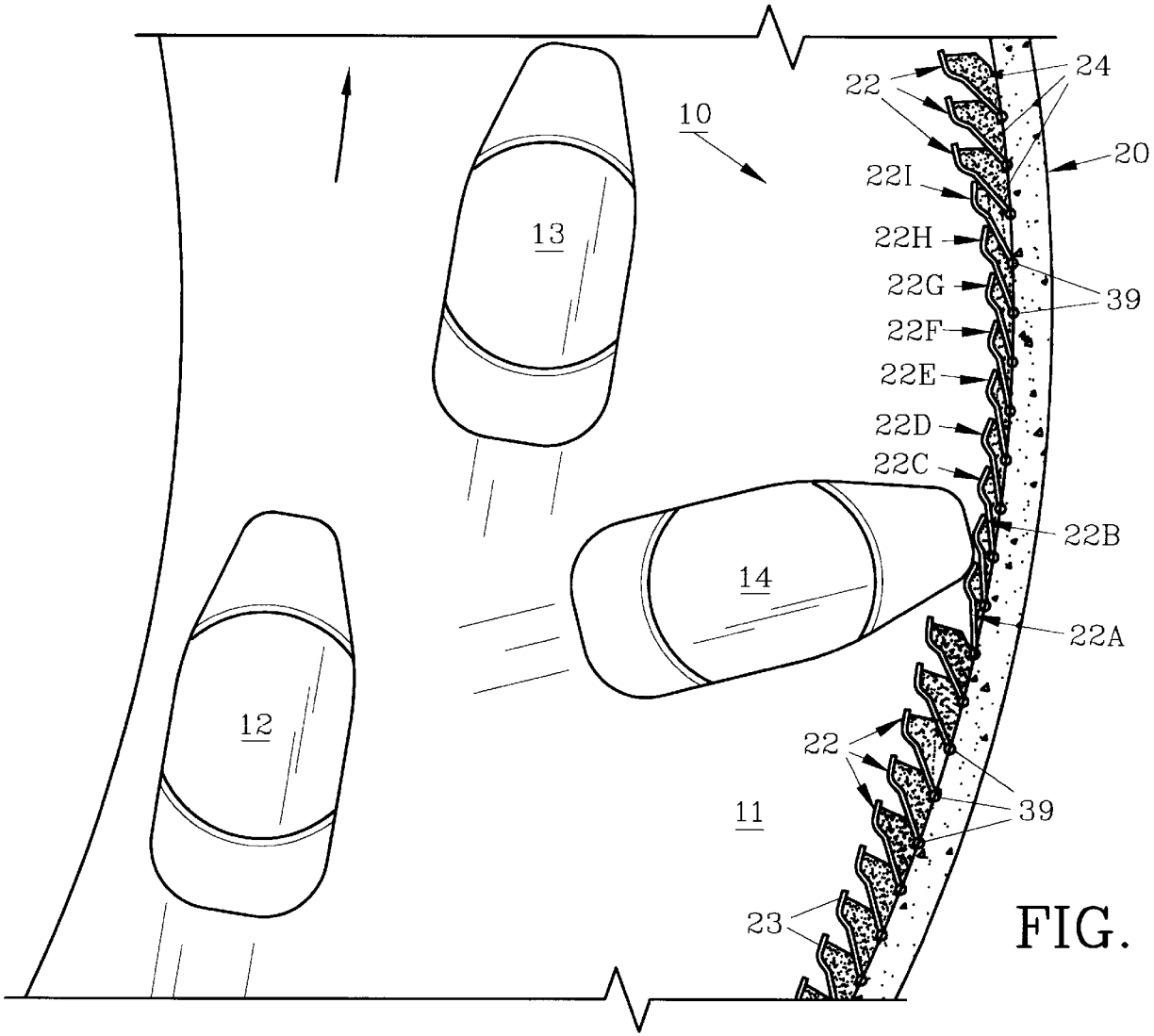
FIG. 2 shows the racetrack section as shown in FIG. 1 but with a race car impacting the energy absorbing system.
Figure 3:
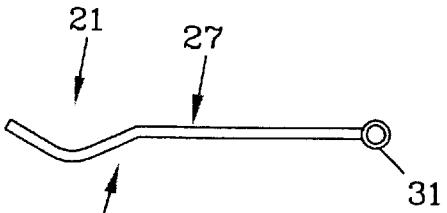
FIG. 3 demonstrates a top view of the rigid plate of one energy absorbing unit.

In FIG. 2, race car 14 has veered from its normal race direction (as shown by the accompanying arrow) and has struck energy absorbing system 10 by impacting energy absorbing units 22A and 22B. By striking energy absorbing units 22A and 225, said energy absorbing units pivot about pins 39 causing succeeding units 22C through 221 to likewise pivot, thereby dissipating energy to lessen the driver's injuries from the impact of race car 14. As would also be understood, during such pivoting motion, steel plate 23 as shown in FIG. 3 which has a somewhat S-shape with arcuate distal end 21 as viewed from above, may be distorted and bent on impact while flexible cushion 24 (FIG. 4) attached is compressed and possibly shattered, further dissipating the energy caused by the impact of race car 14. The exact number of energy absorbing units 22 which are affected and pivot during a particular impact depends in part on the particular angle and force which race car 14 impacts energy absorbing system 10, the specific characteristics of plate 23 and cushion 24 and other factors.

Figure 5:
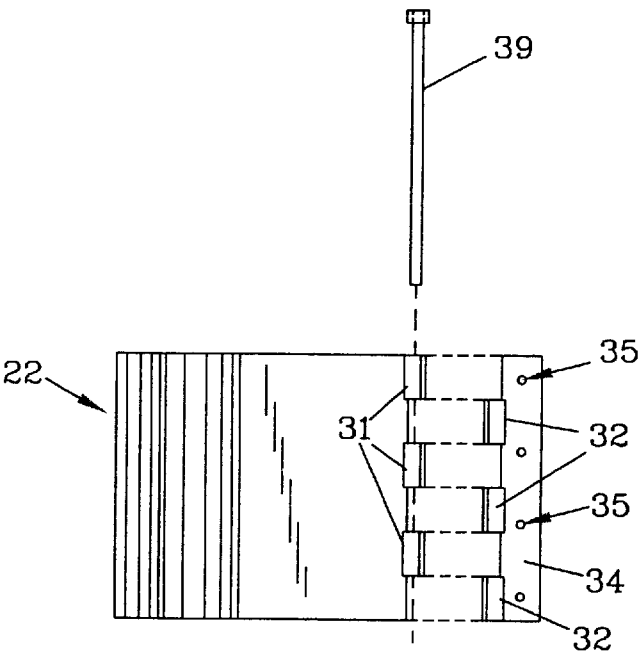
FIG. 5 illustrates a method of pivotally attaching the energy absorbing unit to a racetrack wall utilizing a hinge plate.
Figure 6:
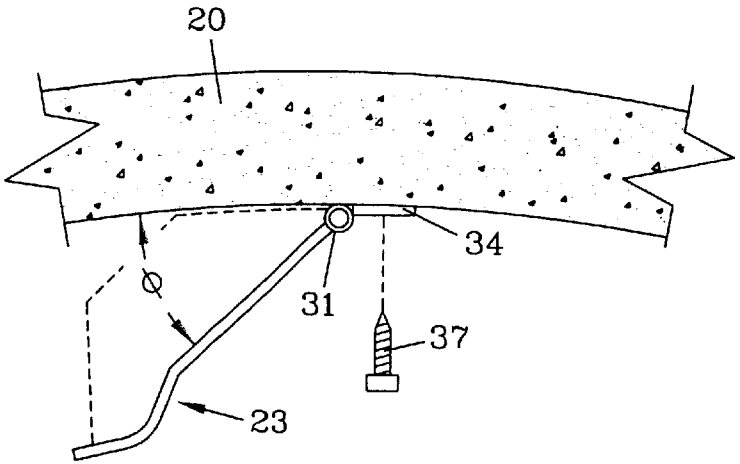
FIG. 6 depicts an enlarged top view of the hinge plate as positioned on the racetrack wall.

Energy absorbing units 22 include preferably a steel plate 23 having a height of approximately three feet (91.44 cm), an overall width of approximately thirty-nine inches (99 cm) and a somewhat S-shape in top view. Plate 23 is preferably formed from approximately three quarter inch (19 mm) steel and includes hinge sections 31 (FIG. 5) at the distal end thereof. Hinge sections 31 are coupled with steel hinge sections 32 affixed to hinge plate 34. Hinge plates 34 preferably include a plurality of apertures 35 for receiving lag bolts 37 as shown in FIG. 6. Lag bolts 37 are preferably about three-quarter inches (19 mm) in diameter and four inches in length (10.16 cm) as sold under the trademark "Wedge-Bolt" of Powers Fasteners of New Rochelle, N.Y. Hinge plates 34 are mounted to a rigid structure such as concrete racetrack wall 20 as shown in FIGS. 1 and 2 at selected intervals in overlapping fashion. Hinge sections 31 of plates 23 are aligned with hinge sections 32 of mounted hinge plates 34 and pin 39 as shown in FIG. 5 is then positioned therethrough to mount the same. Once a crash has occurred with a race car striking one or more energy absorbing units 22, by removing pins 39 energy absorbing units 22 can be easily replaced as required and the race continued with little time lost for repair and clean up.

Figure 4:
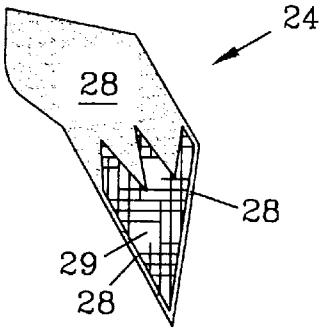
FIG. 4 features a top view of the cushion as affixed to the plate of FIG. 3.

Cushion 24 is formed preferably of polymeric materials and is affixed such as by gluing or the like to rear surface 27 (FIG. 3) of plate 23. Suitable standard adhesives are preferable, depending on exactly the characteristics of cushion 24 although attachment can be by screws, bolts, heat fusion, hook and loop fasteners or otherwise. Cushion 24 includes a tough outer casing 28 formed from preferably a linear polyethylene (LLDPE) as shown in FIG. 4. Inside outer casing 28 is filler 29, preferably formed from a relatively low density, expandable polystyrene (EPS). Manufacturing of cushion 24 can be accomplished by a number of conventional molding or forming techniques such as by rotation molding, vacuum forming, blow molding or injection molding. Outer casing 28 is preferably a low density polyethylene, but can also be a polyethylene of higher density, polypropylene, a high molecular weight polyethylene, nylon or other standard, suitable polymeric materials. A usual ultraviolet stabilizer incorporated into outer casing 28 prevents degradation from exposure to UV rays. Filler 29 of cushion 24 is preferably expanded polystyrene, but may be a standard polyethylene foam, polyester foam, polypropylene foam or a polyurethane foam or the like as suitable. Expanded polystyrene has been found preferable with a relatively low density of approximately one to four pounds per cubic foot (0.45 to 1.8 kg/28.3 l) although other densities may be employed.

The preferred method of dissipating energy to protect drivers, passengers or the like of vehicles which may strike a rigid structure such as a wall includes the steps of mounting an energy absorbing unit such as unit 22 to a wall or other rigid structure to allow energy absorbing unit 22 to pivot. Energy absorbing units 22 will pivot when struck to thereby dissipate energy and protect the passenger from the harsh impact forces. The preferred method of dissipating energy utilizes a plurality of energy absorbing units 22 pivotally mounted angularly at about 30° from the direction of travel to a rigid wall or other structure preferably by hinges, whereby the polymeric cushion 24 can be crushed or shattered, while the rigid front plate 23 remains intact.

The illustrations and examples provided herein are for explanatory purposes and are not intended to limit the scope of the appended claims.

I claim:

1. A method of dissipating energy as caused by a vehicle striking a rigid wall comprising the steps of:

a) mounting a pivotable plate having a planar body portion with an arcuate distal end and having a cushion attached to the body portion, to the wall;

b) striking the plate with the vehicle; and c) allowing the plate to pivot and the cushion to collapse to thereby dissipate energy.

2. The method of claim 1 wherein mounting a pivotable plate comprises the step of mounting a steel plate to a wall.

3. The method of claim 1 wherein mounting a steel plate comprises the step of mounting a steel plate having a cushion with an outer casing containing a low density filler therein.

4. The method of claim 1 wherein mounting a plate comprises the step of hingedly mounting a steel plate to a thick concrete wall.

5. An energy absorbing system for a rigid structure comprising: a plurality of plates, said plates, each comprising a planar body portion, a distal end, said distal end angularly connected to said body portion, said plates pivotally mounted to said rigid structure, said plates normally angularly extending from said rigid structure in spaced apart fashion, a plurality of cushions, each of said plurality of cushions attached to different ones of said plurality of plates, said cushions each comprising an outer casing, a filler, said filler contained within said outer casing, and said plates pivoting into contact with one another when impacted to dissipate energy therefrom.

6. The energy absorbing system of claim 5 wherein said filler is a solid low density polymeric material.

7. The energy absorbing system of claim 5 wherein said distal end is arcuately shaped, said distal end, directed toward said rigid structure.

* * * * *